United States Patent [19]

Schwartz et al.

[11] 4,375,179

[45] Mar. 1, 1983

[54] ACTION FOR ELECTRONIC PIANO

[75] Inventors: Harold O. Schwartz, Elburn, Ill.; Ray F. Gong, Ft. Wayne, Ind.; Victor Durk, Palatine, Ill.

[73] Assignee: The Wurlitzer Company, DeKalb, Ill.

[21] Appl. No.: 200,952

[22] Filed: Oct. 27, 1980

[51] Int. Cl.[3] ..... G10C 3/12

[52] U.S. Cl. ..... 84/439; 84/435; 84/467

[58] Field of Search ..... 84/1.16, 236–240, 84/245–249, 423–425, 433–435, 439–440, 467

[56] References Cited

U.S. PATENT DOCUMENTS

| | | | |
|---|---|---|---|
| Re. 27,015 | 12/1970 | Dijksterhuis | 84/1.26 |
| 1,510,663 | 10/1924 | Finnimore | 84/433 |
| 2,338,992 | 1/1944 | Bilhuber | 84/240 |
| 2,436,875 | 3/1948 | Socin | 84/249 |
| 2,542,308 | 2/1951 | Brown | 84/240 |
| 2,684,006 | 6/1954 | Stein | 84/467 |
| 2,866,371 | 12/1958 | Stein | 84/237 |
| 3,735,076 | 5/1973 | Iijima | 84/423 X |
| 4,091,702 | 5/1978 | Murakami | 84/1.16 |

FOREIGN PATENT DOCUMENTS

| | | | |
|---|---|---|---|
| 146895 | 12/1903 | Fed. Rep. of Germany | 84/467 |
| 54-19729 | 2/1979 | Japan | 84/433 |

*Primary Examiner*—Lawrence R. Franklin

*Attorney, Agent, or Firm*—Trexler, Bushnell & Wolters, Ltd.

[57] ABSTRACT

A piano action is provided for an electronic piano. Tones are generated electronically, but the action retains the feel of a conventional piano action without the necessity of a hammer or hammer-like member. The piano key is provided with a rounded, convex shoulder which presses against a rounded, convex surface on a lever. The two convex surfaces are configured and positioned so that one slides over the other to provide the feel of let-off of a conventional piano action. The lever is spring-biased by means of two different springs to rest position, and acts to move a spring wire contact from a first bus to a second bus.

18 Claims, 15 Drawing Figures

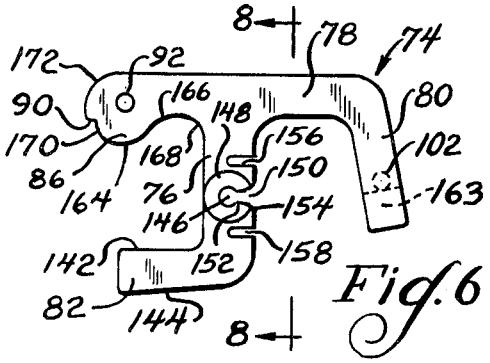
Fig. 6
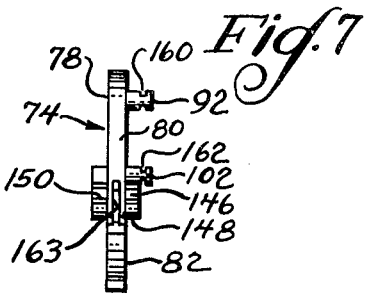
Fig. 7
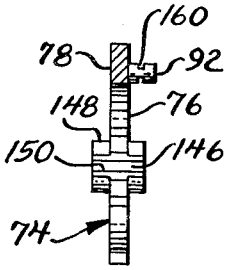
Fig. 8
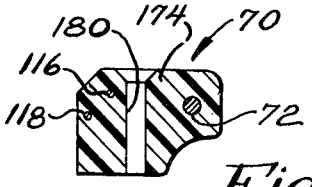
Fig. 10
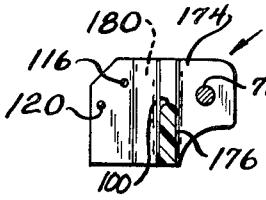
Fig. 11
Fig. 9
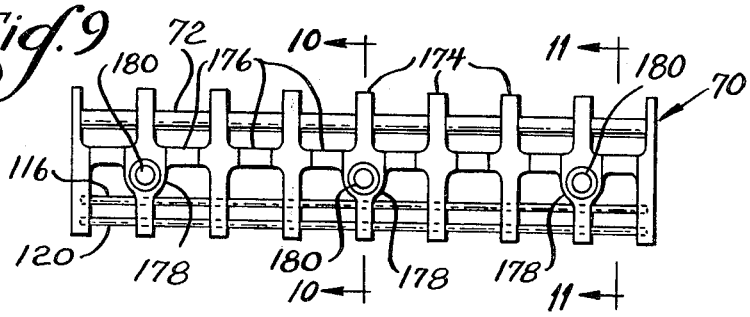

ACTION FOR ELECTRONIC PIANO

BACKGROUND OF THE INVENTION

For a great many years it has been common practice to build pianos with vibratory strings which are hit by hammers forming part of piano actions actuated by the piano keys. Each action has been so constructed that a hammer is started in motion towards its string or strings upon depression of a key. The key and the mechanisms interconnecting the key and the hammer move to a limit position at which the hammer is no longer moved by the key and interconnecting mechanism, but continues solely by virtue of its own inertia into percussive engagement with the respective string or strings, and then rebounds to a rest position. Pianists are used to the feel of the action, particularly the "let-off" at which the hammer is no longer propelled by the key and interconnecting mechanisms, but continues in motion by virtue of its own inertia.

Various efforts have been made heretofore to construct electronic pianos. The most successful of these have utilized a modified piano action in which a hammer is impulsed into percussive engagement with a vibratory member of some sort, for example, a reed, the vibration of which is sensed by means of electrostatic capacitance, or by a magnetic sensor. Such pianos have been portable, but are rather heavy for true portability. In addition, the sound produced thereby has well approximated a piano tone, but has been distinguishable therefrom, particularly in the lower half of the keyboard, due to the different harmonic structure of vibrating strings and other vibratory bodies, such as reeds.

With the advent of modern electronics, in particularly large scale integrated circuits, it has been possible to simulate the sound of a conventional string piano with remarkably realistic sound. A preferred example of a satisfactory circuit for electronic piano tone simulation is to be found in the copending application of William R. Hoskinson, Ser. No. 037,687, filed May 10, 1979, for "Tri-State Encoding Circuit for Electronic Musical Instrument", assigned to the same assignee as the present application. The Wurlitzer Company of DeKalb, Ill.

Electronic tone generators for electronic pianos have been satisfactory in producing desired piano tones. However, pianists have not been satisfied with the touch or feel, since electronic tone generation is effected by movement of a simple switch contact from a rest position to an active position.

Efforts have been made in the past to simulate the feel or touch of a conventional piano without incorporating a hammer which is operative to strike a vibratory member for producing oscillations to effect generation of a piano tone. The patent art discloses moving mechanisms, including movable electromagnetic transducers for effecting electrical switching and simultaneously providing somewhat of a piano feel. There are several such U.S. patents in the name of Dijksterhuis, U.S. Pat. No. 3,231,661 and the reissue thereof, U.S. Pat. No. Re. 27,015 being exemplary.

There is additional patent art relative to piano practice keyboards in which springs and shaped stop devices have been utilized in an effort to produce a piano-like feel, see for example Stein U.S. Pat. No. 2,684,006. Further efforts have been made to utilize interacting lever devices which are supposed to produce a piano-like feel, see for example Murakami U.S. Pat. No. 4,091,702.

To the best of the present applicants' knowledge none of the foregoing or any other electronic pianos have come into commercial use which have electronically generated piano-like tones and have provided the feel or touch of a conventional piano action.

OBJECTS AND BRIEF SUMMARY

The broad object of the present invention is to provide an action for use with an electronic piano, which action utilizes interacting shoulders or convex surfaces adjacent the end of a piano key and on a lever actuated thereby to produce a piano touch or feel which is substantially indistinguishable from that of a conventional string piano, wherein the aforesaid lever moves a switch contact from a second buss. In accordance with the aforesaid copending patent application Hoskinson, Ser. No. 037,687, the transition time of the switch contact from one bus to the next is representative of the force with which a piano key is struck, and the time for movement from one bus to the other is utilized to influence the amplitude of the resulting piano tone.

In carrying out the principles of the present invention, an electronic piano is provided with a plurality of white and black keys in accordance with normal piano practice. The keys are pivoted substantially as in the usual manner of pivoting piano keys. The inner end of each key is provided with a raised convex surface engageable with a somewhat complementary convex surface on a lever. The convex surfaces interact in such manner that there is a distinct feel of let-off in the movement of the lever by the piano key. A spring on the lever provides a desirable influence on the feel, and the feel is improved by the provision of a weight on the inner end of the piano key. The weight may be omitted for weight saving in a portable instrument with only a slight loss in touch. An additional spring acting on the lever at another point biases it toward rest position. The lever also actuates a wire contact for movement between a first and a second bus.

THE DRAWINGS

The present invention will best be understood with reference to the appended drawings and the corresponding specification. In the drawings:

FIG. 1 comprises a sectional view through the action and switching portion of an electronic piano constructed in accordance with the present invention;

FIG. 2 comprises a portion of FIG. 1 with the parts in a different position of operation;

FIG. 3 shows a modification of the key structure as best adapted for commercial use;

FIG. 4 comprises a view taken from the right end of FIG. 3;

FIG. 5 comprises an enlarged detail view of a portion of FIG. 3;

FIG. 6 comprises a detailed side view of a lever forming a part of the present piano action (the part is shown full scale in the original patent drawings);

FIG. 7 comprises a view taken from the right end of FIG. 6 on the same scale;

FIG. 8 comprises a view partially in cross-section taken substantially along the line 8—8 in FIG. 6;

FIG. 9 comprises an end view of a plastic molding carrying the busses and pivot rod for the levers;

FIG. 10 comprises a cross-section taken through the molding of FIG. 9 substantially along the line 10—10 therein;

FIG. 11 comprises a cross-sectional view taken substantially along the line 11—11 in FIG. 9;

DETAILED DESCRIPTION OF THE DISCLOSED EMBODIMENTS

Figures 1, 2, 3, 4, 5:
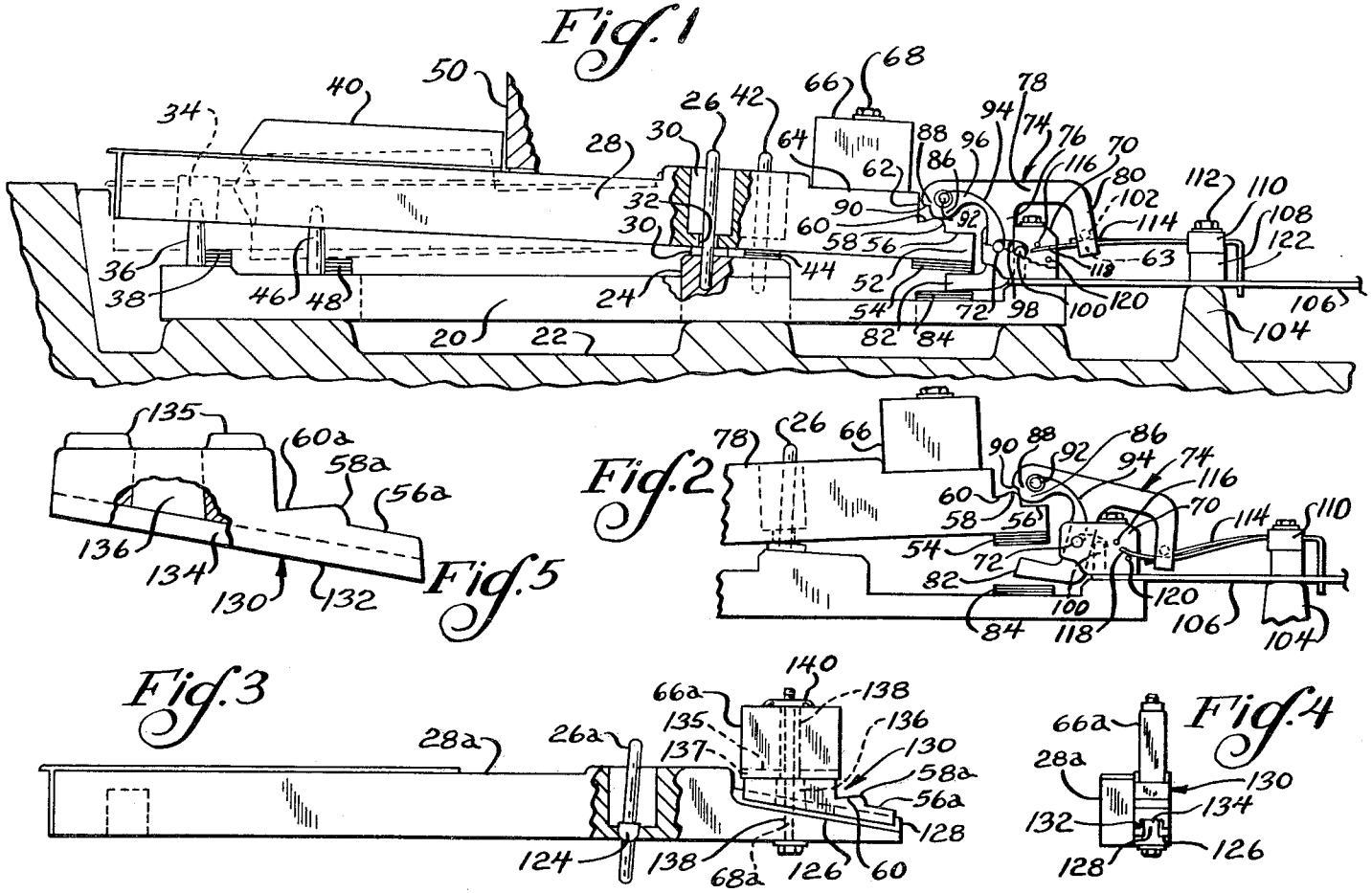

Turning now to the drawings in greater particularity, and first to FIG. 1, there is shown therein an end view of a piano keyboard which displays the keys and remaining action parts in side view. A generally conventional wood key frame 20 is supported on a suitable underlying support 22. The key frame includes a pivot rail 24 having upstanding pins 26 therealong on which the white or natural keys 28 are pivoted in the usual fashion. This includes a felt washer 30 interposed between the pivot rail 24 and each key 28, and a slot 30 in the key permitting pivoting thereof. The slot communicates through a smaller aperture 32 with the space beneath the key, thereby accommodating a respective pin 26. Each key is provided at its outer or left end with a recess 34 receiving an upstanding guide pin 36 preventing side-to-side wobbling of the key. A felt strip 38 comprises a down stop limiting downward movement of a key.

The sharp or black keys 40 are similarly pivoted on a line of pins 42 in the pivot rail 24, respectively resting on felt washers 44. The sharp keys are provided with outer positioning pins 46 and felt down stops 48. Although the washers 30 and 44 and the down stops 38 and 48 have been referred to as felt it will be appreciated that this is exemplary only, and that other suitable cushioning materials could be used. Completing the outer end portion of the keyboard, a fall board is fragmentarily illustrated at 50.

The rightmost or inner end 52 of each key is provided on its under surface with a felt or the like pad 54. A shelf 56 is provided in horizontal position, spaced above the strip or pad 54, and leads to a convex, contoured shoulder 58, relieved at 60 where it joins a vertical wall 62. An upper shelf 64 is provided in horizontal position above this and supports a weight 66, preferably of lead, and secured in place by a bolt 68 passing through the weight and threaded into the top of the inner portion of the piano key.

Immediately adjacent the inner ends of the keys there is provided a plastic molded support 70 carrying a pivot rod 72 on which is mounted a plurality of like levers 74 respectively operated by the keys, and each generally of a T-shape having a depending stem 76 and a cross arm 78. The right end of the cross arm 78 is provided with an oblique depending arm 80. The lower end of the stem 76 is provided with a leftward projection 82. The upper surface of the projection 82 is engaged by the aforesaid felt or the like pad 54 of the corresponding key with the lever in "rest" position as shown in FIG. 1. In such rest position the bottom surface of the projection 82 rests on a felt or other strip 84 limiting the counterclockwise pivoted position of the lever.

Adjacent the left end of the cross arm 78 there is provided a depending cam 86 having a convex configuration engaging with the convex shoulder 58 of the key 28. The cam is not of uniform radius, as will be brought out hereinafter, and is provided with a notch 88 underlying a stop surface 90. Above the cam 86 the lever is provided with a laterally extending integral pin 92. A spring 94 is wrapped around the pivot rod 72 and has a concave underside 96 bearing against the top portion of the lateral pin 92. The opposite end 98 of each spring 94 bears the upper surface of a projection 100 forming a part of the molded support 70. Thus, the spring 94 urges the lever 74 in a counterclockwise direction about the pivot rod 72.

The depending arm portion 80 is provided with a pin 102. Like the pin 92, this pin is integral with the lever 74 and is provided with a peripheral recess. The lever 74 and both pins 92 and 102 are molded of plastic, and thus are electrically insulated.

An upstanding boss 104 on the underlying support 22 supports a printed circuit board 106 which extends also under the molded plastic support members 70. A spacer 108, also of insulating material, overlies the printed circuit board 106 and supports insulating blocks 110 held in place by bolts 112 extending down through the insulating blocks 110 and spacers 108 and threaded into the upstanding boss 104. The insulating block 110 carries biasing springs 114 made of spring wire and bearing up beneath the pins 102, thereby providing a further counterclockwise biasing force to the levers 74. In addition, the contact springs or whiskers 118 extend substantially parallel to the biasing springs 114 and are preloaded up against a first contact bus 116, and are movable by the lever down into engagement with a second bus 120 by the levers 74. The outer ends of the contact wires or whiskers 118 are bent down at 122 and extend through holes in the printed circuit board 106, being suitably secured to the printed wiring thereon. The transit time of each whisker 118 from the first bus 116 to the second bus 120 is important in determining the amplitude and shape of the tonal envelope as is explained more thoroughly in the aforesaid copending application of Hoskinson, Ser. No. 037,687, filed May 10, 1979.

Movement from a rest position of a key, as shown in FIG. 1, to an activated position is shown in FIG. 2. The inner end of the key rises, and the cam 86 drops off of the top convex part of the notch 88 to give a feel of let-off. Meanwhile, the action of the pin 92 sliding against the underside of the spring 94 adds considerably to the piano-like feel. The spring 114 provides added biasing force, while the whisker contact 118 is moved from the first bus 116 to the second bus 120. The cam 86 does not drop entirely onto the shelf 56. However, the shelf is provided so that in the event of wear or other misalignment of the parts there will be a positive stop limiting movement of the key and lever relative to one another, so that there cannot be movement to a position where the key and levers cannot be recocked when the key is released. The surface 90 adjacent the notch 88 at the left edge of the cam 86 also provides insurance against movement of the key too far with regard to the lever.

A modification of the invention as heretofore shown and described is shown in FIGS. 3–5. In these figures similar numerals are used with the addition of the suffix a. The key 28a is essentially the same as originally described except as hereinafter noted. The pivot pin 26a passes through a plastic insert 124 in the key for improved action. The inner end of the key is provided with an oblique recess 126 having an upstanding central flange 128. A plastic molded slide 130 is provided with an oblique under surface 132 having a central groove 134 therein, being complementary to the oblique surface 126 of the key. The actuating member 130, which comprises a plastic molding, is provided relatively toward its left end with a slot 136 running from the groove 134 up through the top thereof. Upstanding bosses 135 lie respectively to the right and to the left of the slot 136. A bolt 68a fits through a bore 138 in the key and extends up through the slot 136, and also through an elongated slot 138 in the lead weight 66a, a nut member 140 being threaded on the top end of the bolt. The lead weight has a longitudinal slot 137 receiving the bosses 135. This allows longitudinal adjustment of the actuating member 130 and also a certain amount of longitudinal adjustment of the lead weight 66a. Such adjustment of the weight will be understood as having an influence on the touch of each key, and the present structure allows adjustment of the touch to fit the requirements of a given pianist.

The actuator is molded of plastic, and has a convex operating shoulder 58a similar to that formed in the wood of the key in FIGS. 1 and 2. There is also provided a shelf 56a which inclines downwardly to the right, generally parallel to the under surface 132. Relief is provided at 60a approximating the recess 60 of FIGS. 1 and 2. It will be appreciated that the actuator 130 may be moved longitudinally of the key to effect proper exact positioning relative to the cam on the under surface of a respective lever.

Further details of the T-shaped lever 74 will be seen with reference to FIGS. 6–8. The stem 76 will be seen to be substantially at right angles with the cross arm 78. The upper surface 142 of the arm 82 will be seen to be at right angles to the lever stem 76. However, the bottom surface thereof 144 will be seen to diverge downwardly to the left at an angle of about 5° from the horizontal and from a right angle with the stem 76. This provides a better interaction with the remaining and cooperating piano parts.

The stem is provided with a central bore 146 of appropriate diameter to receive the pivot rod 72. A collar 148 extends axially of the bore in opposite directions from the lever stem 76 to provide lateral stability during rocking about the pivot shaft 72. The bore 146 opens radially through the collar at 150, to the right as shown in the drawings, specifically FIG. 6 and FIGS. 1 and 2. The inner circumferential opening at 152 is of lesser diameter than the bore 146 and the pivot rod 72. The opening 150 expands outwardly to a maximum diameter at the outer surface 154. The stem is notched above the collar, opening to the right, as indicated at 158. The openings, recesses or notches 156 and 158 allow flexing of the material between them and the collar 158 to permit transverse movement of the lever radially of the bore 146 and of the pivot shaft 72 to allow the lever to be snapped onto the pivot shaft. It has been mentioned heretofore that the lever 74 is of molded plastic, and the substances commonly known as Delrin or nylon are preferred examples.

The depending lever arm 80 is not exactly at right angles to the cross arm 78 of the lever, but rather has an included obtuse angle of approximately 100° for improved cooperation with the biasing springs 114 and switch contact whiskers 118.

In FIGS. 7 and 8 the pin 92 will be seen to have a peripheral recess 160 for receipt of the wire spring 94, preventing the spring from falling off the end of the pin. Similarly, the pin 102 will be seen in FIG. 7 to have a circumferential recess 162.

The bottom end of the arm 80 is provided with a vertical slot 163 (FIGS. 6 and 7) which receives the contact whisker 118. With the parts in rest position the upper limit position of the whisker is limited by the first bus 116 with the whisker out of contact with the upper limit of the slot 163. The lever moves through about the first third of its operated (clockwise) movement before it picks up the whisker and starts to bend it down, thus providing a lost motion interconnection.

For reference purposes, in a particular embodiment of the present invention the total vertical height from the bottom left corner of the lever arm or extension 82 to the top edge of the cross arm 78 is 1.562 inches. The lowermost part of the cam 86 as indicated at 164 comprises an arc of a circle having a radius of 0.25 inch. This merges to the right with an opposite curve at 166 having a radius of 0.28 inch. This then merges into a further circular section or segment 168 having a radius of 0.18 inch. At the left end of the circular segment 164 this segment merges into a circular section having a radius at 170 of 0.156 inch, thus providing a relieved portion. The upper portion above the cam is completed by a circular section of 0.25 inch radius as indicated at 172. For purposes of comparison it is noted at this point that the curved shoulder 58a (FIG. 5) has a radius of 0.093 inch. The total drop from the top of the shoulder 58a to the bottom of the recess 60a is 0.03 inch. The total length of the structure 130 from left to right measured horizontally is 2.098 inches. This part is also molded of plastic, again preferably Delrin or nylon.

Details of the support 70 may be seen in FIGS. 9–11. The support is molded in sections sufficient to correspond to eight keys, again of a plastic material, Delrin or nylon being preferred examples. The support comprises a plurality of parallel, spaced walls 174 interconnected by integral horizontal webs 176, the tops of which have been previously designated 100. Certain of the walls 174, every third one as may be seen in FIG. 9, are provided with thickened portions 178 immediately adjacent the webs 176. These thickened portions 178 are provided with vertical beveled screw holes 180 for receipt of mounting screws to secure the supports 70 and printed circuit board 106 to the key frame 20. The walls 174 are provided with suitable apertures for receipt of the pivot rod 72 and the first and second busses 116 and 120. Springs or weights can be changed as to size or prestressing, or can be omitted as can the weights to adjust the touch to the requirements of an individual keyboard.

A preferred form of the invention is shown in FIGS. 12–15. Many of the parts are the same as or similar to those heretofore discussed. Such parts are identified by the same numerals as heretofore used, but with the addition of the suffix b. To avoid prolixity of discussion only changes will be discussed hereinafter.

One variation is in the structure at the inner end of the key. Rather than having an oblique recess in the inner end of the key, the key is of a construction having a squaredoff end 182. The pivot location for this key, and also for keys in the previous embodiments of the invention, may be offset for natural keys and for sharps and flats as shown in FIG. 1, or all may be in alignment. The key is provided adjacent the inner end with a pair of recesses 184 on the medium line of the key. A plastic base member 186 is mounted on top of the inner end of the key and has a pair of lugs 188 extending into the aforementioned recesses 184. The top of the base 186 is provided with an oblique surface 190 generally corresponding to the oblique surface at 128 in FIG. 3.

The base 186 is provided with an upwardly opening forward recess 192, and a generally similar upwardly opening rear recess 194. Both of these recesses taper upwardly and outwardly for simplicity in molding. The base is also provided with a central recess 196 extending entirely through the base from top to bottom, and tapered outwardly down, again for molding purposes.

A threaded bolt 198 extends through the rear wall 200 of the base. The bolt extends through a non-threaded aperture in the wall.

The plastic molded slide **130*b* is generally similar to the slide 130 and is provided with a central wood screw 204 having a washer 206 under the head thereof extending down through the opening or recess 136*b* in the slide 130*b*, and likewise through the opening 196 in the base 186, having the lower end thereof screwed into the key as indicated at 206. The minimum dimension of the recess or opening 136*b* longitudinally of the key (from left to right in the drawing) is greater than the corresponding diameter of the screw to permit adjustment of the slide to the left and right as in FIG. 12. The oblique undersurface 132*b* of the slide 130*b* is provided near the right end thereof with a depending lug or protruberance 208 received in the recess 192. The left-to-right dimension of the lug 208 is considerably less than the corresponding dimension recess 192 to permit sliding of the slide in either a left or right direction on top of the base. The lug 208 in the direction perpendicular to the drawing sheet is such as to form a sliding fit with the corresponding side walls of the recess 192**.

The slide **130*b* further is provided near its rear (left, FIG. 12) end with a downwardly opening recess 210. This recess flares outwardly toward the opening for facility of molding. An elongated nut member 212 fits in the recess 210 and has the lower end thereof depending into the base recess 194. The lower end 214 is provided with a threaded bore receiving the threaded shank 202 of the bolt 198. Thus, the screw 204 may be loosened, and the bolt 198 turned one way or another to alter the position of the slide on the base. The nut member 214 is, like the screw or bolt 198, preferably constructed of metal. If the bolt hole through the wall 200 is not threaded, then the bolt can only pull on the nut member 212 to adjust the slide to the left in FIG. 12. An upstanding flange 216 is provided at the left end of the slide along the center line thereof to facilitate manual adjustment of the slide. Various expedients are known in the mechanical arts, particularly in vises for locking a rotatable screw against axial movement in a base such as the wall 200**, and any such expedient could be used to allow positive adjustment of the slide in either direction.

Figure 12:
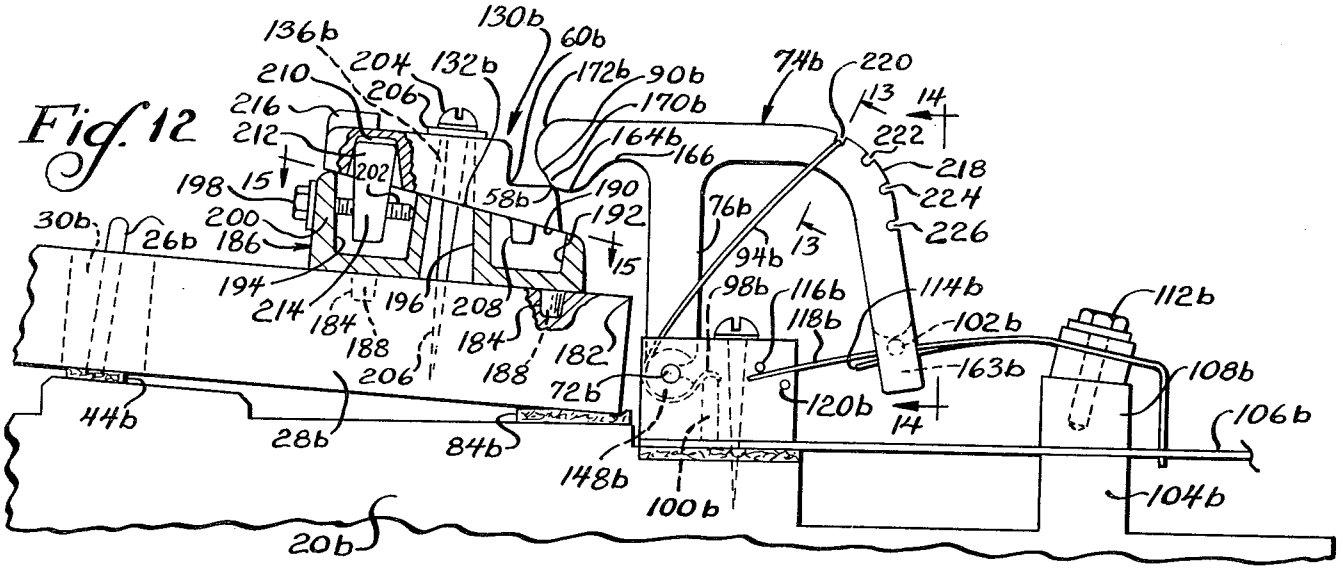
FIG. 12 is a fragmentary side view, partially in section, similar to FIG. 2, and showing a preferred form of the invention.
Figure 14:
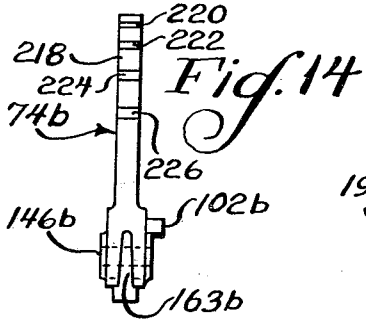
FIG. 14 is a fragmentary end view as taken substantially along the line 14—14 in FIG. 12.
Figure 15:
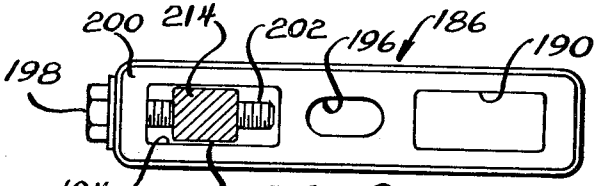
FIG. 15 is an enlarged view taken on a nearly horizontal plane, partially in cross-section, along the line 15—15 in FIG. 12.
Figure 13:
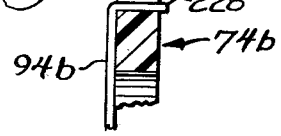
FIG. 13 is a cross-sectional view as taken along the line 13—13 in FIG. 12.

Although no lead weight is shown in connection with the slide and base in FIG. 12, it will be understood that one could be provided as in FIGS. 1–4.

The T-shaped lever **74*b* is generally similar to the T-shaped lever 74 heretofore discussed. However, the upper right shoulder 218 thereof is provided with a series of spaced notches 220, 222, 224, and 226 spaced around the shoulder. The spring 94*b* has the outer end bent over at right angles at 228 for selective receipt in any of the notches 220, 222, 224, or 226 selectively to apply various amounts of spring tension urging the lever in a counterclockwise direction about the pivot rod 72*b*. The spring 98*b* is wrapped around the collar 148*b* of the respective lever 74*b***, and therefore is somewhat foreshortened as the spring is moved in a clockwise direction from one notch to another to increase tension.

In the present instance the leftward extension from the base of the stem **76*b* of the lever 74*b* is omitted. In addition, at the left end of the crossbar the arcuate section 170*b* is less nearly vertical than in previous figures, while the stop surface 90*b* is a substantially less abrupt shoulder. There is some distinction in cooperating parts in that the slide in FIG. 12 does not have a part corresponding to the surface 56*a* of the slide as shown in FIG. 5**.

With the various adjustments of the spring **94*b* there can be an adjustment from about 45 to about 120 grams static pressure to depress the key. Furthermore, the spring 94*b* can be completely removed, and this results in required pressure of only 5 grams static pressure to depress the key, the resistance coming from the whisker contact 118*b* and the spring 114*b***. This, of course, is in the absence of a lead weight.

It will be observed in contrasting FIG. 12 with FIG. 6, and also FIGS. 1 and 2 that the height of the stem **76*b* of the T-shaped lever 74*b* is greater than in the earlier figures. This provides a greater throw on the switch whisker 118*b***.

When the shoulder **58*b* of the slide 130*b* moves into the notch 90*b* (and corresponding parts in earlier figures) the lever 74*b*** may stop moving. Otherwise, it may simply change velocity without necessarily coming to a complete stop. The important thing is that the pianist is able to feel a change in resistance of the key, thus simulating letoff of a conventional piano action.

In some instances it has been found advantageous simply to round off the cam 86 and stop 90, omitting the notch 88.

It will now be apparent that we have provided a simplified lever system for use in an electronic piano which simulates the feel of the action used in a conventional string piano, but without the complexity and cost thereof. The structure affords simple twofold electrical switching which determines not only the note played, but also the envelope thereof. The busses and whiskers can be omitted to provide a silent practice keyboard.

Various changes in structure will no doubt occur to those skilled in the art, and will be understood as forming a part of the present invention insofar as they fall within the spirit and scope of the appended claims.

The invention is claimed as follows:

1. A piano action for use in a piano having no hammers nor associated conventional hammer actions for providing a touch similar to that of said conventional hammer and hammer action and comprising support means, a key having inner and outer ends, means pivotally mounting said key from said support means intermediate the ends of said key for manual pivoting thereof, means interacting between said support means and said key to provide a limit position for said key, a switch actuating operated member, means pivotally mounting said operated member from said support means beyond the inner end of said key, and means biasing said operated member and said key to a rest position, said key on said inner end and said operated member having confronting convex surfaces contacting one another, one of said convex surfaces having convex portions of different radii merging into one another as a continuous convex surface such that said key when manually pivoted from rest position pivots said operated member a predetermined distance with said convex surfaces sliding along one another and off of one of said surface portions on to the other whereupon said operated member changes speed before said key reaches limit position to provide a feel of let-off.

2. A piano action as set forth in claim 1 wherein at least one of said convex surfaces has a relieved portion.

3. A piano action as set forth in claim 1 wherein said biasing means includes spring means acting on said lever, and wherein said spring means comprises a plurality of springs respectively acting on said lever at different positions thereon.

4. A piano action as set forth in claim 3 wherein said biasing means includes a weight on said key.

5. A piano action as set forth in claim 1 wherein said operated member includes a substantially upright stem and a transverse arm adjacent the top thereof, said operated member being pivoted on the stem thereof and the convex surface being on the transverse arm.

6. A piano action as set forth in claim 5 wherein said operated member is substantially T-shaped, said transverse arm extending in opposite directions from said stem, said convex surface being adjacent one end of said arm, said biasing means including spring means acting on said arm substantially adjacent the end opposite said convex surface.

7. A piano action as set forth in claim 6 wherein said biasing means includes further spring means acting on said arm adjacent said convex surface.

8. A piano action as set forth in claim 1 wherein said key inner end has a slideway thereon, a slidable member slidably mounted on said slideway, and means for securing said slidable member in desired position on said slideway, said slidable member having a shoulder thereon providing said key convex surface, said slidable member having a shelf below said shoulder.

9. A piano key construction as set forth in claim 8 wherein said shoulder comprises a cylindrical surface.

10. A piano key construction as set forth in claim 9 wherein said shoulder is relieved on the opposite side thereof from the inner key end.

11. A piano action comprising support means, a key, means pivotally mounting said key from said support means for manual pivoting thereof, a lever having a substantially upright stem and an arm extending laterally therefrom toward said key, means pivotally mounting the stem of said lever from said support means, and means biasing said key and said lever to rest position, said key and said arm of said lever being operatively interconnected for pivoting of said lever upon manual pivoting of said key, said lever being substantially T-shaped and having arms substantially at the top of said stem, one of said arms extending toward said key and the other thereof extending away from said key, a switch mechanism mounted from said support, and means operatively interconnecting said other arm and said switch mechanism for operation of said switch mechanism upon pivoting of said lever.

12. A piano action as set forth in claim 11 wherein the operatively interconnecting means includes a lost motion connection.

13. A piano action as set forth in claim 12 wherein the interconnecting means comprises a projection depending from said other arm.

14. A piano action as set forth in claim 13 wherein said projection has means thereon spaced from said switch mechanism in rest position and subsequently engageable with said switch mechanism following a predetermined pivoting of said lever.

15. A piano action as set forth in claim 14 wherein said projection has a downwardly opening recess receiving a part of said switch mechanism.

16. A piano action as set forth in claim 11 wherein the biasing means comprises a spring bearing on one of said arms.

17. A piano action as set forth in claim 16 wherein the arm extending toward the key has means thereon forming a sliding and bending engagement with said spring.

18. A piano action as set forth in claim 17 wherein the biasing means comprises a second spring operatively engaging the other arm of said lever.

* * * * *